US008205951B2

(12) United States Patent
Boks

(10) Patent No.: US 8,205,951 B2
(45) Date of Patent: Jun. 26, 2012

(54) CLOSING DEVICE FOR DRAWERS

(75) Inventor: Michael J. Boks, Grand Rapids, MI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 0 days.

(21) Appl. No.: 12/914,519

(22) Filed: Oct. 28, 2010

(65) Prior Publication Data

US 2011/0101839 A1 May 5, 2011

Related U.S. Application Data

(60) Provisional application No. 61/257,927, filed on Nov. 4, 2009.

(51) Int. Cl.
*A47B 88/04* (2006.01)

(52) U.S. Cl. ..... 312/319.1; 312/333; 312/331

(58) Field of Classification Search ..... 312/330.1, 312/331, 333, 334.1, 334.7, 334.8, 319.1, 312/334.44, 334.45, 334.46, 249.11, 402; 384/20–21; 16/49, 64, 71, 79
See application file for complete search history.

(56) References Cited

U.S. PATENT DOCUMENTS

| | | | | |
|---|---|---|---|---|
| 5,015,048 | A | 5/1991 | Brunnert | |
| 5,240,318 | A | 8/1993 | Schroder et al. | |
| 6,629,738 | B2 * | 10/2003 | Salice | 312/333 |
| 6,848,759 | B2 | 2/2005 | Doornbos et al. | |
| 6,910,557 | B2 | 6/2005 | Doornbos et al. | |
| 6,915,716 | B2 | 7/2005 | Doornbos et al. | |
| 6,932,511 | B2 | 8/2005 | Doornbos et al. | |
| 7,077,488 | B2 | 7/2006 | Wiklund et al. | |
| 7,281,773 | B2 * | 10/2007 | Sato et al. | 312/333 |
| 7,815,267 | B1 * | 10/2010 | Frousiakis | 312/333 |
| 2001/0008037 | A1 * | 7/2001 | Brustle | 16/71 |
| 2004/0104649 | A1 | 6/2004 | Muller et al. | |
| 2004/0183411 | A1 * | 9/2004 | Boks | 312/333 |
| 2007/0046158 | A1 | 3/2007 | Hoffman | |
| 2008/0197759 | A1 * | 8/2008 | Chen et al. | 312/334.1 |
| 2008/0224584 | A1 * | 9/2008 | Weber et al. | 312/334.27 |
| 2008/0244862 | A1 * | 10/2008 | Tooyama | 16/82 |
| 2009/0021129 | A1 * | 1/2009 | Hu et al. | 312/333 |
| 2009/0033187 | A1 * | 2/2009 | Chung | 312/319.1 |

FOREIGN PATENT DOCUMENTS

WO WO 2008069248 A1 * 6/2008

OTHER PUBLICATIONS

International Search Report for PCT/US2010/055124 dated Jan. 11, 2011.

Written Opinion of the International Searching Authority for PCT/US2010/055124 dated Jan. 11, 2011.

* cited by examiner

*Primary Examiner* — James O Hansen
*Assistant Examiner* — Sasha T Varghese
(74) *Attorney, Agent, or Firm* — Cook Alex Ltd.

(57) ABSTRACT

A closing device that includes a latching member that when moved a given distance utilizes a gear to effect a mechanical advantage that results in an end of a biasing member being moved less than the given distance. The biasing member is used in moving a first drawer slide member to a closed position relative to a second drawer slide member, and use of the gear and the resulting mechanical advantage provide a smoother transition when the first drawer slide member is engaged or disengaged from the closing device.

29 Claims, 7 Drawing Sheets

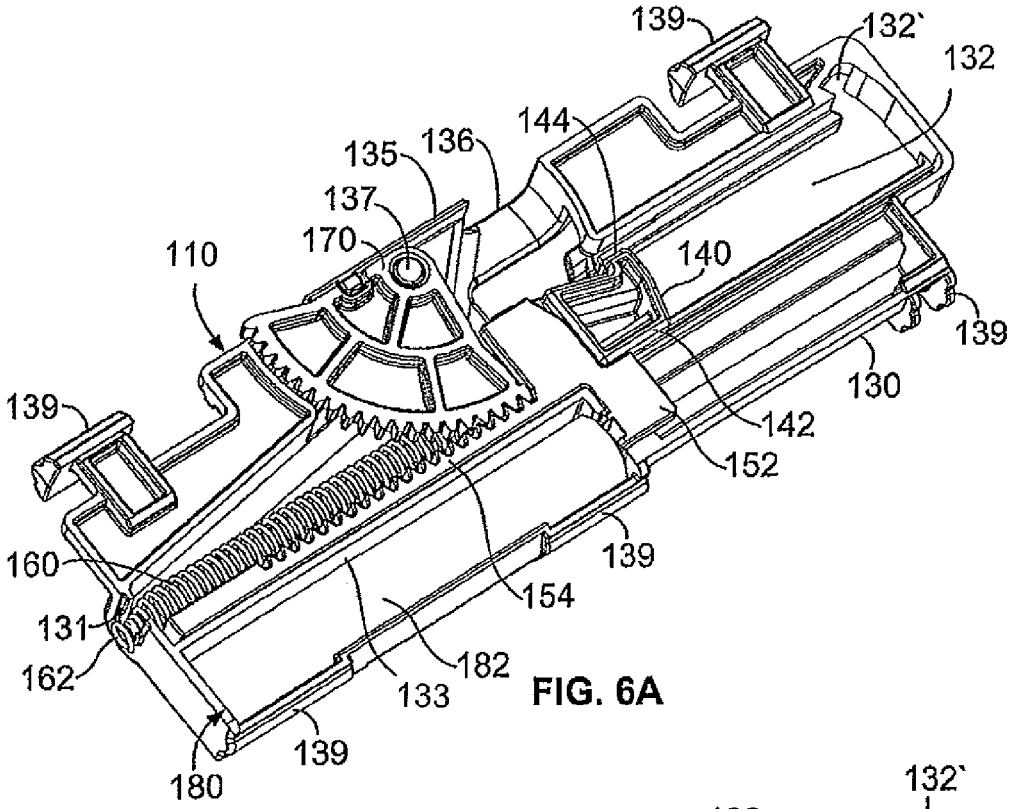
FIG. 6A
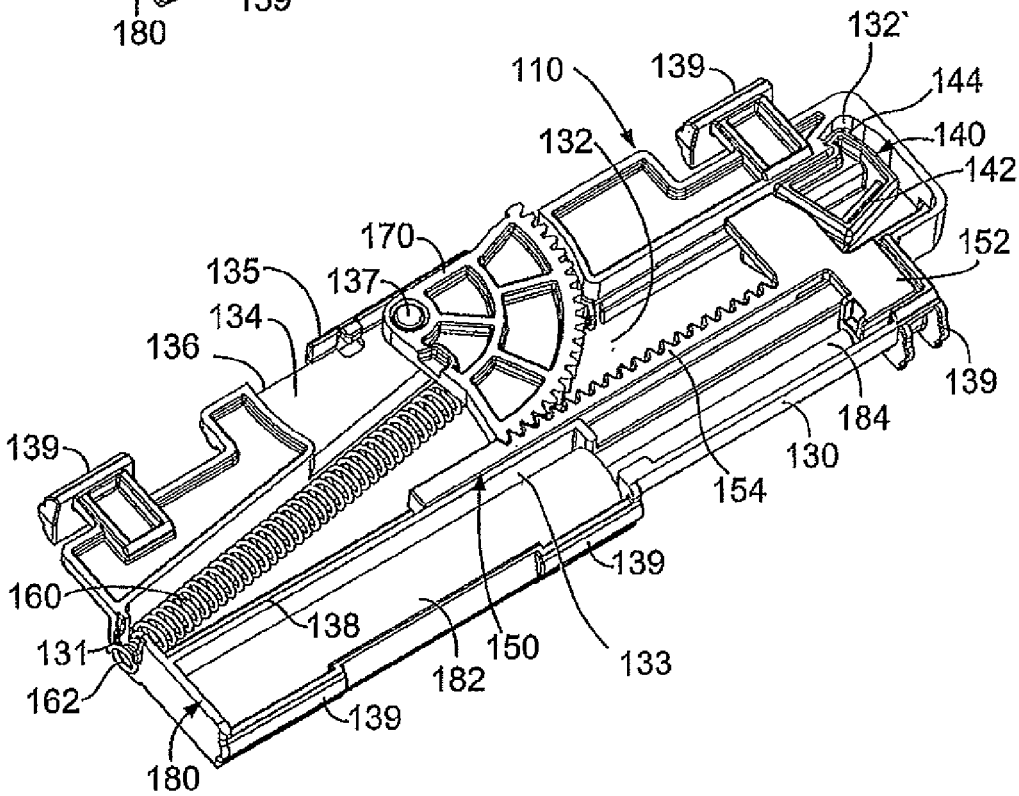

CLOSING DEVICE FOR DRAWERS

CROSS-REFERENCE TO RELATED APPLICATION

This application claims priority from U.S. Provisional Patent Application No. 61/257,927, filed Nov. 4, 2009, the disclosure of which is hereby incorporated by reference in its entirety.

FIELD OF THE DISCLOSURE

The present invention generally relates to closing devices that often are incorporated into drawer slides otherwise known as self-closing drawer slides. Such drawer slides tend to be used in articles of furniture, such as cabinet assemblies, for assisting in moving a drawer to a fully closed position within the cabinet body.

BACKGROUND

Articles of furniture having drawers, such as cabinet assemblies, typically include drawer slides for mounting the drawers to the cabinet assembly and for providing a way to move the drawer between a fully closed position within the cabinet body to an open position with the drawer extending outward from the cabinet body. Standard drawer slides tend to be mounted in pairs, with one on each of the left and right outer sides of the drawer, or in an undermount format beneath and along respective outer left and right edges of the drawer. In such configurations, on each side of the drawer, one drawer slide member is attached to the cabinet body and a second drawer slide member is attached to the drawer. Bearings, such as ball or roller bearings, typically are disposed between the drawer slide members for smooth movement of the drawer relative to the cabinet body. The bearings may be organized and located within a bearing retainer. Also, there may be a third drawer slide member coupled to and between the first and second drawer slide members, with a corresponding additional set of bearings, to permit further extension of the drawer from the cabinet body.

In both the standard and undermount configurations, it is desirable to assist a user in closing a drawer, to prevent rebound of the drawer, and to tend to hold the drawer in a closed position. There are numerous self-closing drawer slide devices designed to be engaged as a drawer is being closed and reaches a predetermined distance from the cabinet face. Such devices often incorporate a spring to help pull or push the drawer to the fully closed position. It is common for these devices to include a latching member that is used in controlling the movement of the drawer relative to the cabinet body within a pre-selected range of motion of the drawer. Such prior art devices often include a pin or tab to engage the latching member to move it from a latched to an unlatched position or vice versa. In turn, either the latching member or pin commonly is associated with one of the drawer sides or slide members, while the other corresponding component is associated with another drawer slide member.

While such a latching member and pin assembly function for their intended purpose, they tend to transmit fairly high forces to the user at the transition point of engagement or disengagement of the latching member, as occurs upon release when the drawer is being moved in an outward direction toward an open position and reaches the end of the travel of the latching member under the influence of a spring, or upon initial engagement when the drawer is being moved in an inward direction toward a closed position. The prior art devices tend to have a spring with an end that is moved in essentially a one-for-one ratio relative to the movement of a latching member, such that the force generated by the spring is increased linearly as the latching member is moved outward with the drawer, until the latching member is released and parked in an armed position. This results in operation with an on-off or jerky feel with respect to the influence of the spring when the latching member enters and exits the armed position.

Thus, it is common among the prior art closing devices for the spring force resisting the opening of the drawer to continue to increase in a consistent manner until the latching member reaches the end of its travel, and then releases the drawer, resulting in an abrupt transition from a maximum pulling force resisting the opening of the drawer to no resistance to further opening of the drawer. This construction tends to result in a jerking motion that is unsettling to the user and may cause the contents of the drawer to shift abruptly. Similarly, when closing the drawer, the influence of the spring is brought on rather suddenly when its peak force is applied upon initial reengagement of the latching member and release from its latched position.

This undesirable transition is due, in part, to the need to have the spring maintain a sufficient level of spring force even when the drawer is nearly in a fully closed position, so as to be able to completely close the drawer and to prevent the drawer from rebounding to an open position if pushed inward rapidly, such as when a drawer is being slammed closed. The high spring force at the point of release or reengagement of the latching member also can result in undesirable noise due to the abrupt movements of the latching member into or out of an armed position and the level of force transmitted by the latching member to the complementary component on the other drawer slide, drawer or cabinet member.

It is desirable to provide a closing device for drawers that can be incorporated into a drawer slide while avoiding the potential disadvantages of self-closing drawer slides that use a latching member that experiences a consistent increase in spring force when a latching member is being moved from a first position when a drawer is closed to a second position when the drawer has been moved toward a fully open position. It is to be understood that both the foregoing general description and the following detailed description are exemplary and provided for purposes of explanation only, and are not restrictive of the disclosure, as claimed. Further features and objects of the present disclosure will become more fully apparent in the following description of a preferred embodiment and from the appended claims.

BRIEF DESCRIPTION OF THE DRAWINGS

In describing the preferred embodiments, reference is made to the accompanying drawings wherein like parts have like reference numerals, and wherein:

FIG. 6A is a perspective bottom view of a second example closing device, in a closed position.

FIG. 6B is a perspective bottom view of the closing device of FIG. 6A, with the latching member in an armed position.

Figure 1:
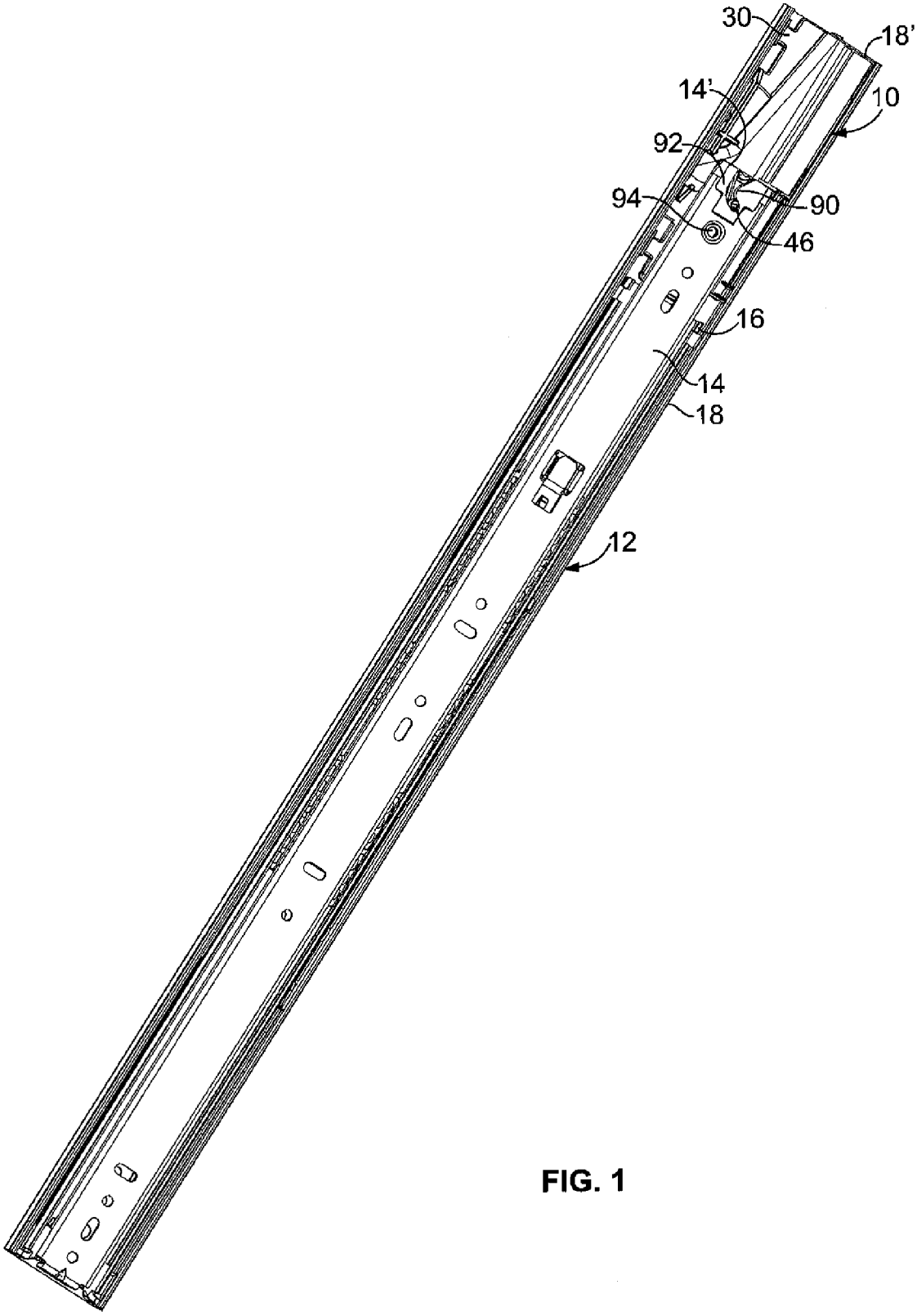
FIG. 1 is a top view of a drawer slide assembly including a first example of a closing device.

It should be understood that the drawings are not to scale and that actual embodiments may differ. It also should be understood that the claims are not limited to the particular examples illustrated or combinations thereof, but rather cover various configurations of closing devices for drawers.

SUMMARY

The following discloses example of improved closing devices which impart a mechanical advantage that results in the application of a biasing force that is not increased in a consistent or uniform manner when compared to the linear movement of a latching member that is coupled to one of the drawer slide members. Thus, instead of continuing to increase the biasing force to be applied at the disengagement/engagement point of the latching member at a uniform linear rate, the disclosed example closing device has a biasing member but is configured to have a latching member that does not move at the same rate as an the biasing member is lengthened. Thus, the increase in the biasing force is at a reduced rate per unit length of movement as the drawer slide continues to move outward until the latching member reaches its armed position.

The present disclosure provides improved use of a closing device that employs a mechanical advantage during movement of the latching member to permit a common biasing member to be used while mitigating undesirable transition forces. The disclosure provides a damper, which may be optionally included to assist in damping rapid movement of a drawer slide member when moving to a closed position, so as to catch a drawer that is coupled to the drawer slide assembly and allow the closing device to assist in more gently moving the drawer to a fully closed position. Hence, the present disclosure addresses shortcomings in prior art self-closing drawer slide assemblies, while providing quiet, smooth-operating closing devices for use with a drawer.

In a first aspect, the present disclosure provides a closing device having a base, a latching member that is coupled to a rack that slidably engages the base, a gear coupled to the base and engaging the rack, a biasing member having a first end coupled to the base and a second end coupled to the gear, and wherein the biasing member generates a biasing force as it is lengthened and the rack and gear engagement provides a mechanical advantage that alters the biasing force applied to the latching member in a manner that does not correspond linearly to movement of the latching member.

In a second aspect, the present disclosure presents a closing device, for use in a drawer slide having a first drawer slide member that is slidably coupled to a second drawer slide member. The closing device includes a base connectable to the second drawer slide member, a latching member slidably coupled to the base, the latching member having an armed position and a closed position. The latching member is coupled to a rack that is slidably engaged with the base, and the closing device further includes a gear pivotally coupled to the base and being engaged with the rack, and a biasing member coupled to the base and the gear, the biasing member being adapted to urge the gear to pivot and thereby drive the latching member to the closed position.

DETAILED DESCRIPTION

Although the following discloses example closing devices shown for use with drawers coupled to drawer slides, persons of ordinary skill in the art will appreciate that the teachings of this disclosure are in no way limited to the specific examples illustrated. On the contrary, it is contemplated that the teachings of this disclosure may be implemented in alternative configurations and environments. In addition, although the example closing devices described herein are shown in conjunction with a particular configuration of a drawer slide assembly, those having ordinary skill in the art will readily recognize that the componentry of the example closing devices may be used in a drawer slide, whether of a side mount or undermount construction, or may be mounted independently of a drawer slide.

Referring to FIGS. 1-5C, it will be appreciated that a first example closing device of the present disclosure generally may be embodied within numerous configurations within a device that may be incorporated into a drawer slide assembly, such as a self closing drawer slide, and/or an article of furniture having a drawer and cabinet assembly. Thus, the apparatus and articles of manufacture and methods disclosed herein may be advantageously adapted to enhance or improve the closing features of a drawer slide or drawer within a cabinet assembly, where the term "cabinet assembly" is used to indicate an article of furniture that may be a cabinet, desk or other furniture structure having at least one drawer. Accordingly, while the following disclosure uses the term cabinet assembly and describes examples of a closing device for use with a drawer that is mounted via a drawer slide assembly, and methods of use thereof, persons of ordinary skill in the art will readily appreciate that the disclosed example is not the only way to implement such a closing device and/or methods of use thereof.

Referring to a preferred embodiment in FIGS. 1-5C, a first example closing device 10 is shown incorporated into a form of a self-closing drawer slide. The closing device 10 is shown coupled to a drawer slide 12 having a first drawer slide member 14 for attachment by conventional means to a drawer (not shown), a second drawer slide member 16 is coupled to and slidably engages the first drawer slide member 14, and a third drawer slide member 18 is coupled to and slidably engages the second drawer slide member 16 for attachment by conventional means to a cabinet body of a cabinet assembly (not shown). Use of the intermediate, second drawer slide member 16 permits greater extension of a drawer from the face of a cabinet body when in the fully opened position, and often drawer slides of this type are referred to as full extension drawer slides. However, while the closing device 10 of the preferred embodiment is configured to be coupled to a drawer slide 12 of the full extension side mount type, it will be appreciated that the componentry of the first example drawer closing device of the present disclosure could be incorporated into other configurations, whether as incorporated into drawer slides having two or three slide members, into drawer slides of the side mount or undermount type, or into direct mountings to a drawer or cabinet body without being incorporated into one or another drawer slide member.

For the first example closing device 10, slidable engagement between the respective first and second drawer slide members 14 and 16, and between the respective second and third drawer slide members 16 and 18, is achieved with use of bearings (not shown). In this embodiment, although not shown, the bearings are preferably of the ball bearing type, of conventional steel construction, and held in a retainer assembly. However, it will be appreciated that the slidable engagement could be achieved with other types of bearings, such as roller bearings, or other slide elements, and that such alternative components could be made of various other suitable materials, such as plastic, metal alloys or the like. Similarly, slidable engagement between the respective drawer slide members 14 and 16, and between drawer slide members 16 and 18, may be but need not be of the same type.

As shown more particularly in the first example in FIG. 1, the closing device 10 is coupled to the third drawer slide member 18 near a first end 18', which will be referred to herein as the proximal end. First end 18' of the third drawer slide member 18 would normally be installed along an inner side wall surface of a cabinet body and near the rear of the side wall. This results in a particularly compact mounting arrangement that is not viewable by a user while the third drawer slide member 18 is mounted to the cabinet body and the drawer is mounted to the first drawer slide member 14. As best seen in FIGS. 2A-5C, closing device 10 preferably includes: a base 30, a latching member 40, a rack 50, a biasing member 60, a gear 70 and a damper 80, which are configured to interact via the latching member 40 with a corresponding actuation member 90 that is coupled to or formed into the first drawer slide member 14 at a proximal first end 14'. The base 30, the latching member 40, the rack 50 and the gear 70 are preferably constructed of molded plastic and each may be formed of a single piece, as shown, or of an assembly of components. The biasing member 60 is shown in the form of a coiled, linear rate extension spring and it, as well as the drawer slide members 14, 16 and 18 are preferably constructed of steel or other suitable materials. Each of the components of the closing device 10 will be further described, followed by a description of their operative coupling and function.

In this first example device 10, the base 30 is coupled to the slide member 18. The biasing member 60 is coupled at a first end to the slide member 12, via the base 30 including a socket 31 at its proximal end to receive a first end portion 62 of the biasing member 60. The base 30 slidably receives the latching member 40 in a slide channel 32. The slide channel 32 includes a notch 32' proximate its distal end. The base 30 further includes a damper holder 33 that receives the damper 80. The base 30 has a planar section 34 in its central region, from which projects a stop wall 35 along an outer edge 36. A post 37 extends from the planar section 34 for pivotal coupling to the gear 70, and the stop wall 35 may be used to limit the pivotal movement of the gear 70. A slide rail 38 extends along the damper holder 33 for slidable interaction with the rack 50.

In this first example, the base 30 is configured to be readily attachable to the third slide member 18 proximate its proximal end 18', to facilitate simple, rapid and secure mounting that also reduces the potential for interference with other components of the assembly. For instance, the base 30 includes locating members 39 of various configurations and which extend outward to permit the base 30 to be snap fit within the third slide member 18. However, one of ordinary skill in the art will appreciate that the base 30 may be coupled to the third slide member 18 in numerous different ways, including by use of separate fasteners, adhesives or other interlocking features on the base or slide member.

The latching member 40 is slidably engaged with the third slide member 18 via its pivotal coupling to the rack 50, because the rack 50 is slidably engaged with the base 30 that is coupled to the third slide member 18. For instance, the latching member 40 has a central body 42 that is slidably received within the slide channel 32. A hook portion 44 extends from the distal end of the central body 42 for engagement with the notch 32' when the latching member 40 reaches the distal end of the slide channel 32.

The latching member 40 also may be selectively coupled to the first drawer slide member 14. This can be seen in that the latching member 40 includes a pin 46 that is formed as an upstanding projection and which is configured to be coupled to and uncoupled from the actuation member 90, which is shown in the form of a curved slot that is located at the proximal end of the first drawer slide member 14. The latching member 40 further includes an aperture 48 in the lower surface of the central body 42 for pivotal coupling to the rack 50. It will be appreciated that these structures could be reversed with respect to the placement of the pin and curved slot on opposite members.

In this first example closing device 10, the rack 50 is engagable with the gear 70, as the rack 50 includes a flat body 52 from which is extended a linear, elongated toothed section 54 for toothed engagement with the gear 70. The rack 50 also includes an upstanding post 56 that is received by the aperture 48 in the latching member 40 to effect the aforementioned pivotal coupling of these two components. Further included in the rack 50 is an upstanding hub 58 for coupling of the damper 80 to the rack 50, as will be described further herein.

The biasing member 60 is illustrated as a coil, linear rate extension spring, although it will be appreciated that other biasing members and configurations may be employed. The biasing member 60 has a first end portion 62 coupled to the base 30 via a narrowed section for coupling to the base 30 by insertion into the socket 31, and a second end portion 64 in the form of a loop coupled to the gear 70. Selecting a proper length for the biasing member 60 will keep the latching member 40 at the proximal end of its travel when a drawer is in the closed position, and will help avoid contact with other components and the resultant noise associated with such contact.

In this example, the gear 70 is configured to be relatively flat and sector-shaped, having an arcuate toothed section 72 for engagement with the elongated toothed section 54 of the rack 50. The gear 70 includes an aperture 74 for pivotal coupling to the post 37 on the planar section 34 of the base 30. The gear 70 also includes a tab 76 for coupling to the loop of the second end portion 64 of the biasing member 60.

The damper 80 has an outer housing 82 that is received by the base 30 in the damper holder 33. An actuating rod 84 is extendable from the distal end of the damper 80 and is coupled to the rack 50 via being coupled to the upstanding hub 58. This coupling between the damper actuating rod 84 and the hub 58 of the rack 50 causes damped linear movement of the latching member 40, as it is coupled to the rack 50. The damper 80 preferably dampens only in the closing or retracting direction, but it will be appreciated that the damper 80 could dampen movement in both the retracting and extending directions.

The first example is shown with the actuation member 90 configured as a curved slot formed in a plastic insert 92 which is coupled by a fastener 94 to the first end 14' of the first drawer slide member 14. It will be appreciated that the slot may be otherwise formed directly into the first slide member 14 or provided via a different piece and that such piece may be coupled to the first slide member 14 by suitable methods of coupling components, such as by use of one or more mechanical fasteners, a press fit, a bonding agent, or the like. The actuation member 90 interacts with the pin 46 on the latching member 40, and as noted above the respective structures could be reversed.

According to the present disclosure, there is provided a closing device 10 having a base 30, a latching member 40 that is coupled to a rack 50 that slidably engages the base 30, a gear 70 coupled to the base 30 and engaging the rack 50, a biasing member 60 having a first end 62 coupled to the base 30 and a second end 64 coupled to the gear 70, and wherein the biasing member 60 generates a biasing force as it is lengthened and the engagement of the rack 50 with the gear 70 provides a mechanical advantage that alters the biasing force applied to the latching member 40 in a manner that does not correspond linearly to movement of the latching member 40.

The present disclosure further provides a closing device 10, for use in a drawer slide 12 having a first drawer slide member 14 that is slidably coupled to a second drawer slide member 18. The closing device 10 includes a base 30 connectable to the second drawer slide member 18, a latching member 40 slidably coupled to the base 30, the latching member 30 having an armed position and a closed position. The latching member 40 is coupled to a rack 50 that is slidably engaged with the base 30, and the closing device further includes a gear 70 pivotally coupled to the base 30 and being engaged with the rack 50, and a biasing member 60 coupled to the base 30 and the gear 70, the biasing member 60 being adapted to urge the gear 70 to pivot and thereby drive the latching member 40 to the closed position.

Figure 2A:
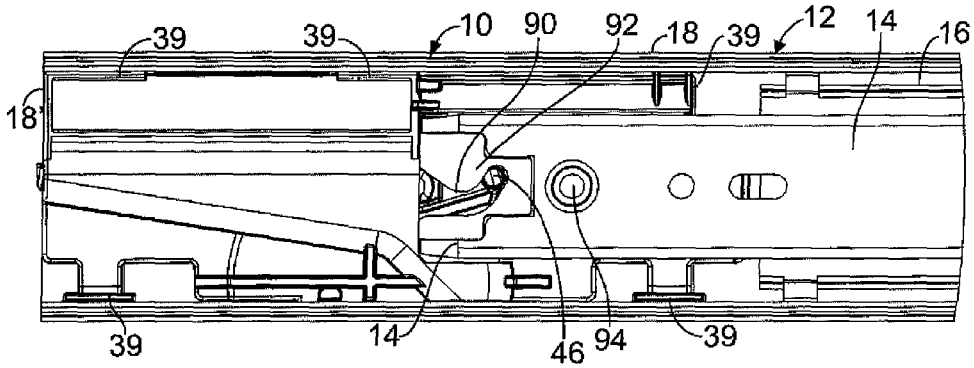
FIG. 2A is a top view of an inward end portion of the drawer slide assembly of FIG. 1 in a fully closed position.
Figure 2B:
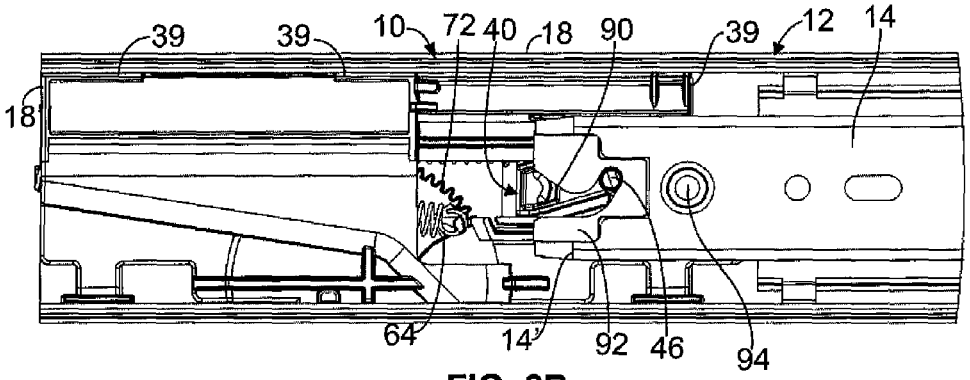
FIG. 2B is a top view of an inward end portion of the drawer slide assembly of FIG. 1 wherein a first drawer slide member is shown with the closing device engaged but in a position where the drawer slide is not fully closed.
Figure 2C:
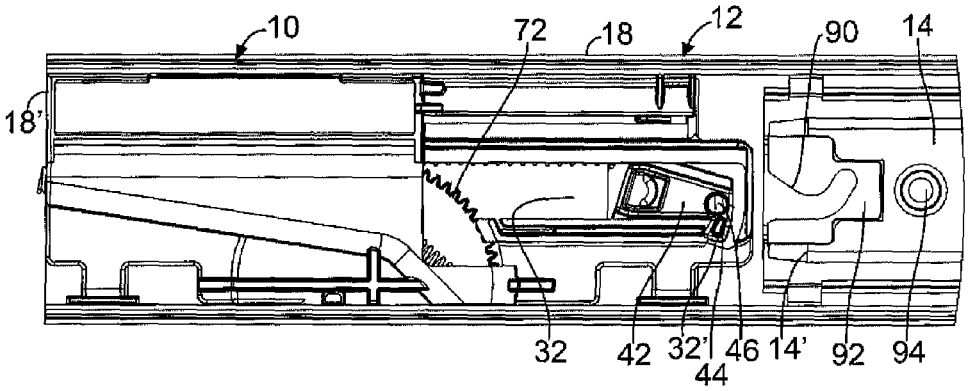
FIG. 2C is a top view of an inward end portion of the drawer slide assembly of FIG. 1 wherein a first drawer slide member is shown when the closing device is no longer in engagement, as it is in a range of motion beyond the influence of the closing device.
Figure 3A:
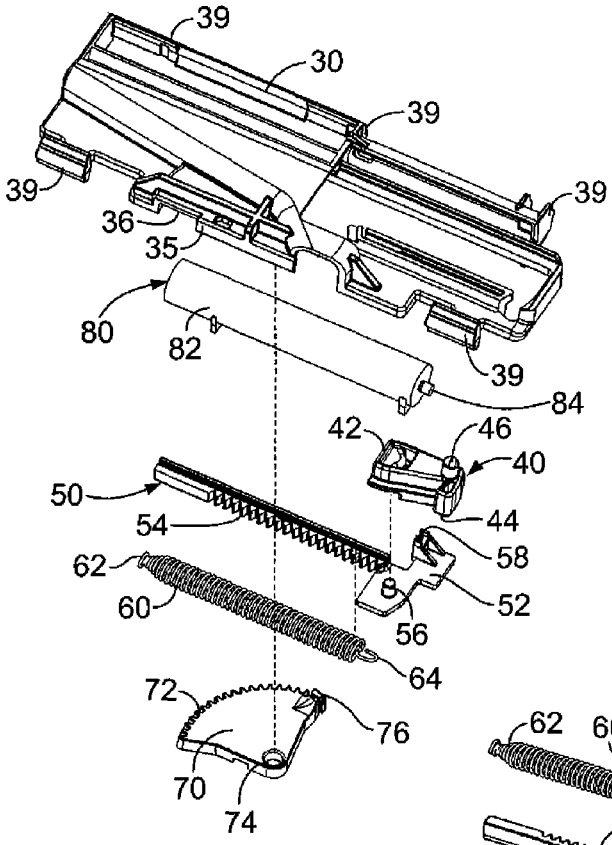
FIG. 3A is a perspective exploded top view of the closing device of FIG. 1, in a closed position.
Figure 3B:
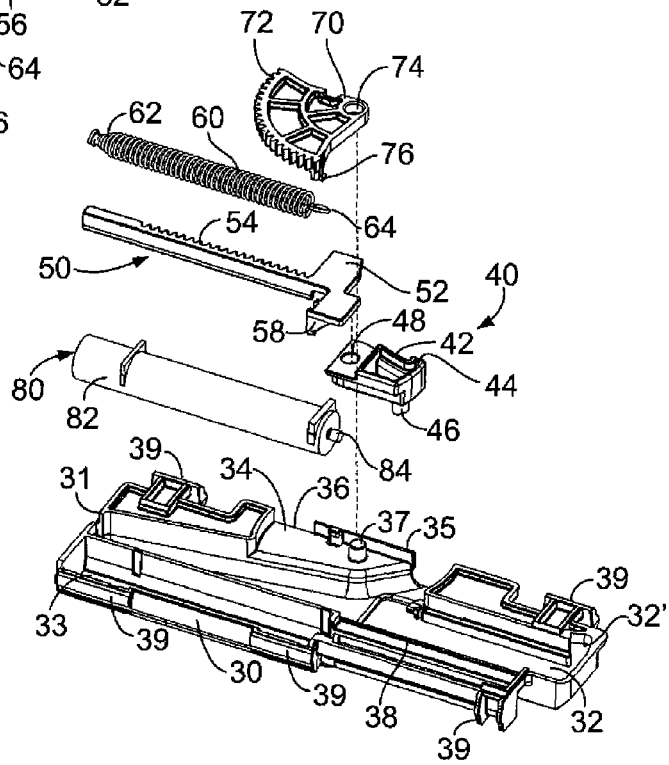
FIG. 3B is a perspective exploded bottom view of the closing device of FIG. 1, in a closed position.
Figure 4A:
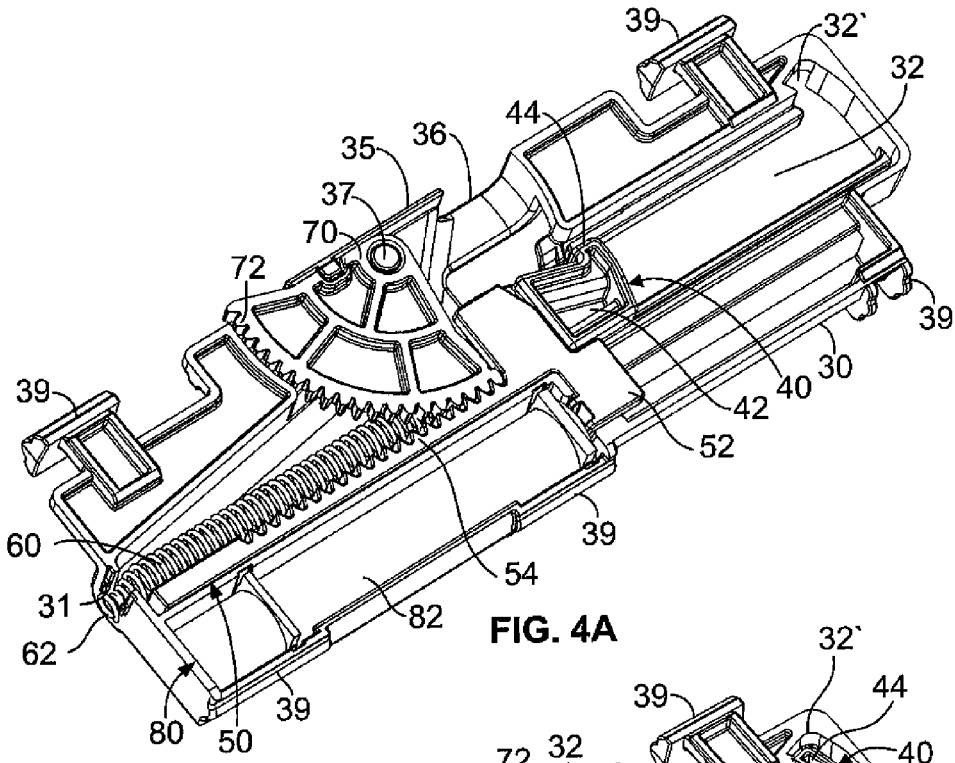
FIG. 4A is a perspective bottom view of the closing device of FIG. 1, in a closed position.
Figure 4B:
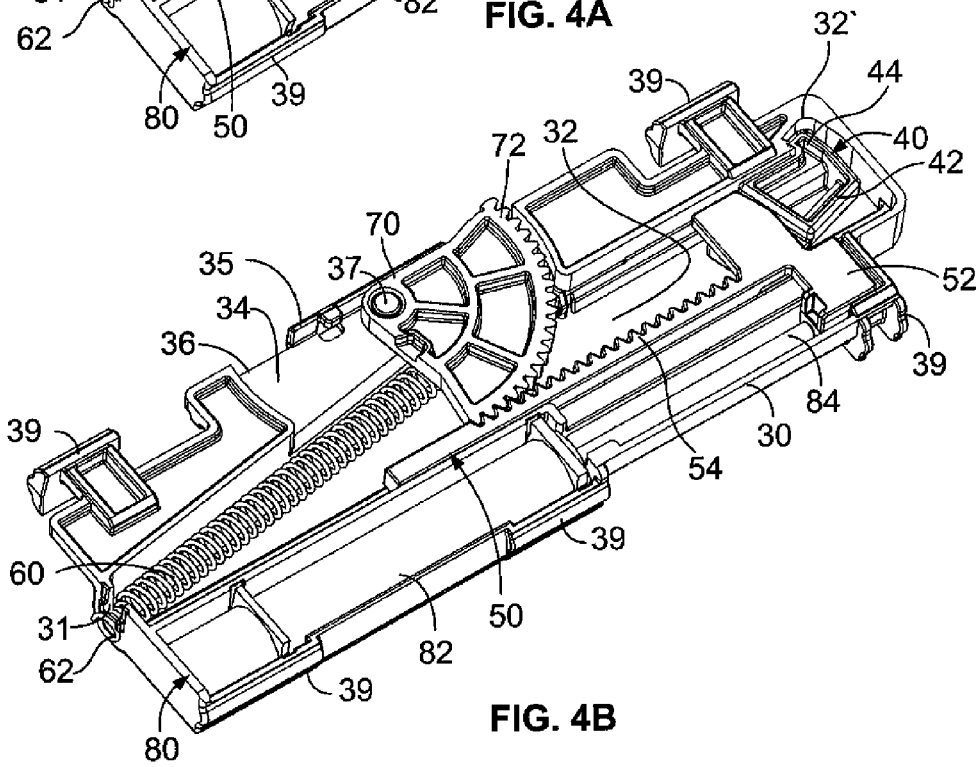
FIG. 4B is a perspective bottom view of the closing device of FIG. 1, with the latching member in an armed position.

Now turning to a description of the operative coupling and function of the components. With the third drawer slide member 18 coupled to an inner surface of a cabinet side wall of a cabinet body (not shown) and the first drawer slide member 14 coupled to the outer surface of a drawer side wall (not shown), the closing device 10 is employed to control the final closing motion of the drawer. FIGS. 2A-2C show the motion of the closing device 10 and first drawer slide member 14 in successive positions as they would be moved from a closed position toward an open position. For illustrative purposes, the underside of the device is shown in corresponding positions in FIGS. 5A-5C, although it will be understood that the position shown in FIG. 5C would be maintained at any time that the drawer has been moved beyond a point at which the latching member 40 would be engaged with the actuation member 90.

The latching member 40, pivotally coupled to the rack 50, is shown at the proximal end of its travel in FIGS. 2A, 3A, 3B, 4A and 5A. In this position, the arcuate toothed section 72 of the gear 70 is engaged with the elongated toothed section 54 of the rack 50 at one end. The gear 70 rests against the stop wall 35 along one side of the sector-shaped gear 70, limiting its pivotal travel, while the teeth at one end of the arcuate toothed section 72 of the gear 70 are aligned with the teeth at the distal end of the elongated toothed portion 54 of the rack 50, for meshed movement of the toothed sections 54, 72. In this position, the biasing member 60 is in a first position in which it has relatively little or no tension, to avoid sagging and to keep the drawer in the closed position, and the latching member 40 is at the proximal end of its travel within the slide channel 32. The damper rod 84 is in its retracted position within the damper 80 while coupled to the hub 58 of the rack 50.

Figure 5A:
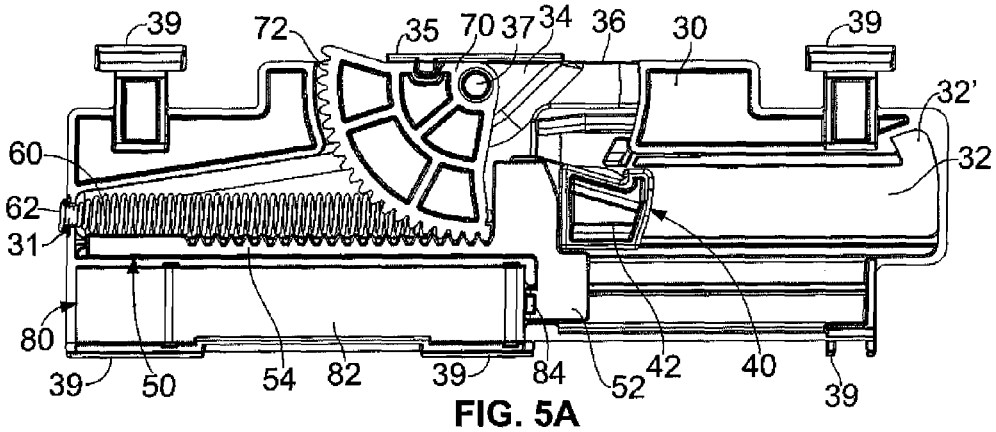
FIG. 5A is a bottom view of the closing device of FIG. 1, in a closed position.
Figure 5B:
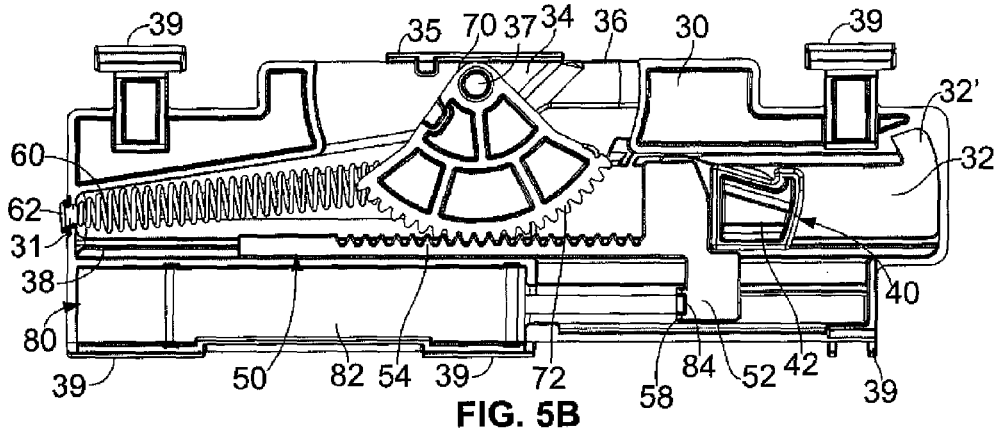
FIG. 5B is a bottom view of the closing device of FIG. 1, with the latching member in a position between a closed position and an armed position.

FIGS. 2B and 5B illustrate a position of the first drawer slide member 14 early in its movement toward an open position or late in its movement toward the closed position. As shown, the pin 46 on the latching member 40 is forced by the wall of the actuation member 90 to move in the distal direction. In turn, this forces the latching member 40 to move along the slide channel 32, forcing the rack 50 to slide along the slide rail 38. As the rack 50 is moved, the toothed engagement with the gear 70 forces the gear 70 to pivot. The pivotal movement of the gear 70 causes the tab 76 to move through an arc about the post 37, moving the loop at the second end portion 64 of the biasing member 60, thereby changing the length of the biasing member 60. As the gear 70 pivots, it provides a mechanical advantage that imparts a change in the ratio of linear movement of the rack 50 to the lengthening of the biasing member 60.

Figure 5C:
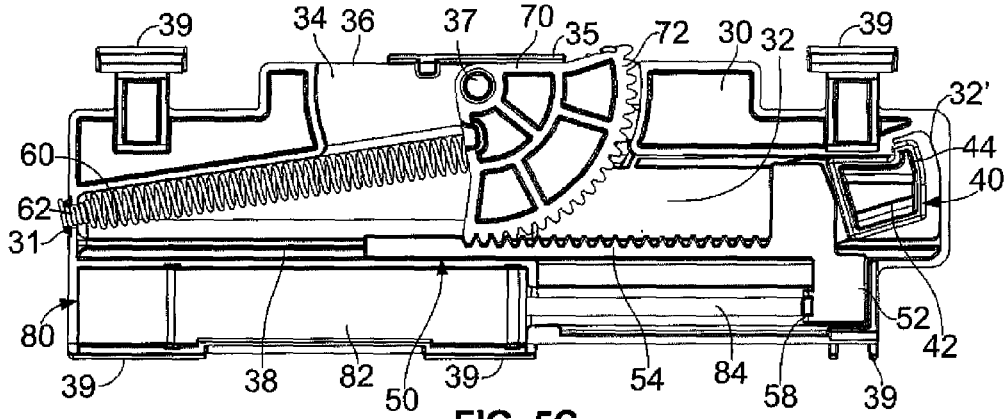
FIG. 5C is a bottom view of the closing device of FIG. 1, with the latching member in an armed position.

As the first drawer slide member 14 continues to move toward an open position, the curved slot of the actuation member 90 forces the pin 46 laterally, causing the hook portion 44 on the latching member 40 to enter the notch 32' of the slide channel 32, achieving a latched or armed position, as shown in FIGS. 2C and 5C. FIG. 2C actually shows the actuation member 40 in the latched or armed position and the first drawer slide member 14 having moved slightly further toward an open position of the drawer and no longer being under the influence of the closing device 10. The movement of the latching member 40 to its armed position also advances the rack 50 and its toothed elongated section 54 along the slide rail 38. In turn, the engagement of the rack 50 with the arcuate toothed section 72 of the gear 70 causes the gear 70 to pivot to a position against stop wall 35, limiting the pivotal movement of the gear 70. The ends of travel may be limited simultaneously or alternatively by the ends of travel of the rack 50 along its slide rail 38 and/or by the travel of the latching member 40 within the slide channel 32.

The tab 76 on the gear 70 is positioned so that when the hook portion 44 on the latching member 40 reaches the notch 32' and assumes its armed position, the biasing member 60 has not passed the pivotal coupling of the gear 70 to the base 30, or the top-dead-center position, and instead is kept in tension and continues to bias the gear 70 to pivot toward the returned position associated with the closed position of the drawer.

With the further movement of the latching member 40 to its armed position, the pivotal movement of the gear 70 causes the biasing member 60 to be further stretched but at a reduced ratio relative to the linear movement of the rack 50 that is pivotally coupled to the latching member 40. The mechanical advantage provided with the disclosed arrangement permits the use of a biasing member 60 having a linear rate spring while effectively reducing the rate of increase in the applied spring force as the first drawer slide member 14 moves the latching member 40 toward the armed position. This arrangement results in the closing device 10 having sufficient biasing force to move and keep a drawer closed, while also having a lower ultimate biasing force present at the point of disengagement or reengagement of the drawer with the drawer closing device in comparison to prior art devices where the biasing force continues to increase at the same rate as a closing element moves. As a result, the user experiences a more pleasing transition between a drawer being under the influence of the closing device 10 and being free to move beyond the range of motion of the closing device 10.

As the drawer and the first slide member 14 move from an open position toward the closed position, the actuation member 90 at the proximal end 14' of the first drawer slide 14 reengages the pin 46 on the latching member 40 and forces the latching member 40 to pivot about the post 56 on the rack 50, withdrawing the hook portion 44 from the notch 32' at the end of the slide channel 32. With the hook portion 44 unlatched, the tensioned biasing member 60 causes the toothed gear 70 to pivot, in turn causing the toothed rack 50 to slide along the slide rail 38 of the base 30. The pivotal coupling of the rack 50 to the latching member 40 results in the latching member 40 and the drawer being pulled to the closed position.

Thus, as the drawer is advanced toward a closed position within the cabinet body, the proximal end 14' of the first drawer slide member 14 is moved within a selected range of motion proximate the proximal end 18' of the third drawer slide member 18, such as within the last two inches of travel of the drawer slide 12. In this example, the curvature in the slot of the actuation member 90 at the end of the first drawer slide member 14 is configured to assist in capturing and releasing the pin 46 on the latching member 40. The interaction between the curved slot of the actuation member 90 and the pin 46 controls the pivotal motion of the latching member 40 to force the hook 44 to selectively engage and disengage the notch 32' in the slide channel 32 of the base 30 for latching and unlatching of the latching member 40. It will be appreciated that the pin 46 may be constructed in other suitable forms or shapes, and that with some modification, the pin and slot coupling components may be reversed or incorporated into the drawer slide, drawer and/or cabinet in other suitable ways, or the latching and actuating members may be configured in other forms.

Referring to FIGS. 6A-7B, a second example closing device 110 that may be incorporated into a drawer slide or article of furniture having a drawer and cabinet assembly is illustrated. The second example is substantially similar to the first example and operates in a similar manner. Therefore, it will be described in a somewhat abbreviated manner, focusing on the main differences relative to the first example and, for ease of reference, using a numbering sequence that corresponds to the first example.

The second example closing device 110 may be adapted for use in ways similar to those described above in regard to the first example device 10. Thus, the second example device 10 can be incorporated into a drawer slide as shown in FIGS. 1 and 2A-2C, and which will be referenced herein as if the second example closing device 110 is coupled to the drawer slide 12. The closing device 110 preferably includes: a base 130, a latching member 140, a rack 150, a biasing member 160, a gear 170 and a damper 180, which are configured to interact via the latching member 140 with a corresponding actuation member 90 that is coupled to or formed into the first drawer slide member 14 at a proximal first end 14'. The base 130, the latching member 140, the rack 150 and the gear 170 are preferably constructed of similar materials to those discussed above in reference to the first example device 10.

In this second example closing device 110, the base 130 would be coupled to the third slide member 18. The biasing member 160 is coupled at a first end to the slide member 12, via the base 130 including a socket 131 at its proximal end to receive a first end portion 162 of the biasing member 160. The biasing member 160 is shown in the form of a coiled, linear rate extension spring and it is preferably constructed of steel or other suitable materials.

The base 130 slidably receives the latching member 140 in a slide channel 132. The slide channel 132 includes a notch 132' proximate its distal end. The base 130 further includes a damper holder 133 that receives the damper 180. The damper 180 and corresponding damper holder 133 of the second example 110 are narrower than the damper 80 and damper holder 33 of the first example device 10. The base 130 has a planar section 134 in its central region, from which projects a stop wall 135 along an outer edge 136. A post 137 extends from the planar section 134 for pivotal coupling to the gear 170, and the stop wall 135 may be used to limit the pivotal movement of the gear 170. The gear 170 of the second example device 110 has a larger radius than the gear 70 of the first example device 10. A slide rail 138 extends along the damper holder 133 for slidable interaction with the rack 150.

As with the first example device, the base 130 of the second example device 110 is configured to be readily coupled to the third slide member 18 proximate its proximal end 18', to facilitate simple, rapid and secure mounting that also reduces the potential for interference with other components of the assembly. The base 130 includes locating members 139 of various configurations and which extend outward to permit the base 130 to be snap fit within the third slide member 18. The locating members 139 along the outer edge 136 in the second example device 110 are quite similar to the locating members 39 of the first example device 10, but they are spaced a little differently. As with the first example device 10, it will be appreciated that the base 130 may be coupled to the third slide member 18 in numerous different ways.

The latching member 140 is slidably engaged with the third slide member 18 via its pivotal coupling to the rack 150, because the rack 150 is slidably engaged with the base 130 that is coupled to the third slide member 18. For instance, the latching member 140 has a central body 142 that is slidably received within the slide channel 132. A hook portion 144 extends from the distal end of the central body 142 for engagement with the notch 132' when the latching member 140 reaches the distal end of the slide channel 132. The latching member 140 also may be selectively coupled to the first drawer slide member 14. This can be seen in that the latching member 140 includes a pin 146 that is formed as an upstanding projection and which is configured to be coupled to and uncoupled from the actuation member 90 located at the proximal end of the first drawer slide member 14. The latching member 140 further includes an aperture in the lower surface of the central body 142 for pivotal coupling to the rack 150, which is not shown in FIG. 7A but is similar to aperture 48 shown in FIG. 3B.

As with the first example, in the second example device 110, the rack 150 is engagable with the gear 170, as the rack 150 includes a flat body 152 from which is extended a linear, elongated toothed section 154 for toothed engagement with the gear 170. The rack 150 also includes an upstanding post 156 that is received by the aperture in the lower surface (not shown) of the latching member 140 to effect the aforementioned pivotal coupling of these two components. Further included in the rack 150 is an upstanding hub 158 for coupling of the damper 180 to the rack 150, as will be described further herein. The flat body 152 and hub 158 are shaped a little differently from the flat body 52 and hub 58 of the first example rack 50, but perform the same functions as previously described.

The biasing member 160 has a first end portion 162 having a narrowed section for coupling to the base 130 via insertion into a socket 131, and a second end portion 164 in the form of a loop for coupling to the gear 170. Selecting a proper length for the biasing member 160 will keep the latching member 140 at the proximal end of its travel when a drawer is in the closed position, and will help avoid contact with other components and the resultant noise associated with such contact.

In the second example, the gear 170 having a slightly larger radius still is configured to be relatively flat and sector-shaped, having an arcuate toothed section 172 for engagement with the elongated toothed section 154 of the rack 150. The gear 170 includes an aperture 174 for pivotal coupling to the post 137 on the planar section 134 of the base 130. The gear 170 also includes a tab 176 for coupling to the loop of the second end portion 164 of the biasing member 160. It will be appreciated that the mechanical advantage obtained by using a gear and rack can be selected as desired. For instance, the larger gear 170 of the second example closing device 110 results in a different extension ratio between the movement of the latching member 140 and the lengthening of the biasing member 160, yielding approximately a 15 percent increase in latching member travel relative to spring deflection when compared to the components in the first example closing device 10.

The damper 180 has an outer housing 182 that is received by the base 130 in the damper holder 133. An actuating rod 184 is extendable from the distal end of the damper 180 and is coupled to the rack 150 via an upstanding hub 158. This coupling between the damper actuating rod 184 and the hub 158 of the rack 150 causes damped linear movement of the latching member 140 because it is coupled to the rack 150. The damper 180 preferably dampens only in the closing or retracting direction, but it will be appreciated that the damper 180 could dampen movement in both the retracting and extending directions.

The second example device 110 is shown with the same drawer slide components having the actuation member 90 configured as a curved slot formed in a plastic insert 92 which is coupled by a fastener 94 to the first end 14' of the first drawer slide member 14. As discussed previously, it will be appreciated that there may be alternative constructions for such structure. In any event, the actuation member 90 interacts with the pin 146 on the latching member 140.

With respect to the operative coupling and function of the components of the second example device 110, it will be appreciated that it operates essentially in the same manner as the first example device 10. Accordingly, with the third drawer slide member 18 coupled to an inner surface of a cabinet side wall of a cabinet body (not shown) and the first drawer slide member 14 coupled to the outer surface of a drawer side wall (not shown), the drawer closing device 110 is employed to control the final closing motion of the drawer. The motion of the second closing device 110 is similar to that shown and described with respect to the first example device, in FIGS. 2A-2C and in FIGS. 5A-5C.

Figure 7A:
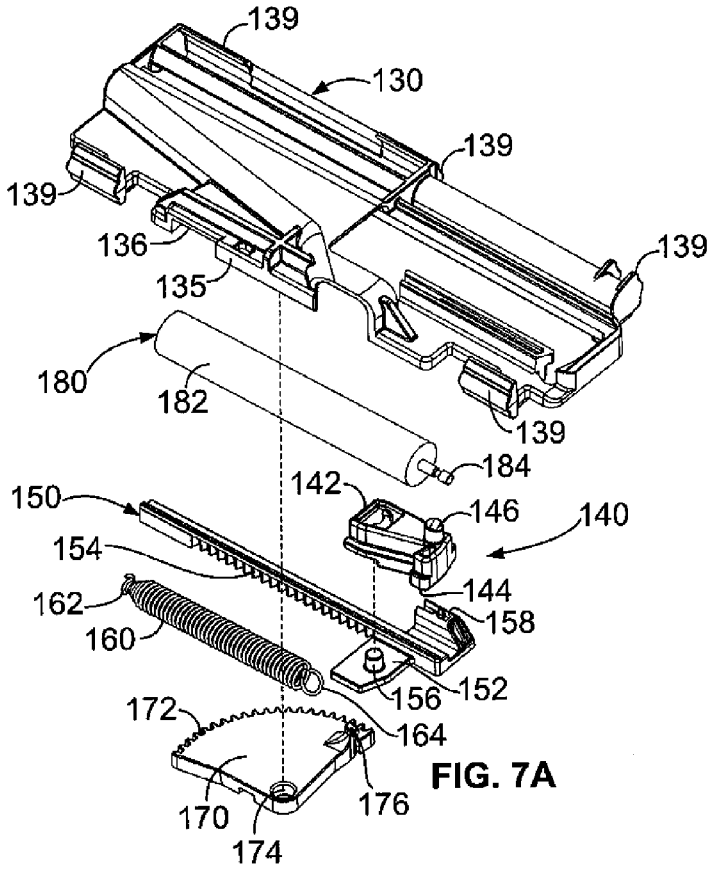
FIG. 7A is a perspective exploded top view of the closing device of FIG. 6A, in a closed position.
Figure 7B:
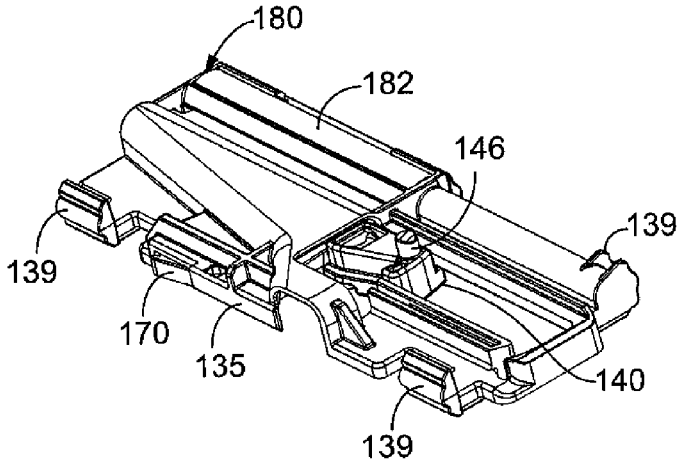
FIG. 7B is a perspective top view of the closing device of FIG. 6A, in a closed position.

Thus, the latching member 140, pivotally coupled to the rack 150, is shown at the proximal end of its travel in FIGS. 6A and 7A. In this position, the arcuate toothed section 172 of the gear 170 is engaged with the elongated toothed section 154 of the rack 150 at one end. The gear 170 rests against the stop wall 135 along one side of the sector-shaped gear 170, limiting its pivotal travel, while the teeth at one end of the arcuate toothed section 172 of the gear 170 are aligned with the teeth at the distal end of the elongated toothed portion 154 of the rack 150, for meshed movement of the toothed sections 154, 172. In this position, the biasing member 160 is in a first position in which it has relatively little or no tension, to avoid sagging and to keep the drawer in the closed position, and the latching member 140 is at the proximal end of its travel within the slide channel 132. The damper rod 184 is in its retracted position within the damper 180 while coupled to the hub 158 of the rack 150.

FIG. 6B illustrates a position of the second example device in which the first drawer slide member 14 has been moved toward an open position and has disengaged from the latching member 140. Thus, prior to reaching this position, the pin 146 on the latching member 140 has been forced by the wall of the actuation member 90 to move in the distal direction. In turn, this forced the latching member 140 to move along the slide channel 132, forcing the rack 150 to slide along the slide rail 138. As the rack 150 moved, the toothed engagement with the gear 170 forced the gear 170 to pivot. The pivotal movement of the gear 170 caused the tab 176 to move through an arc about the post 137, moving the loop at the second end portion 164 of the biasing member 160, thereby changing the length of the biasing member 160. As the gear 170 pivoted, it provided a mechanical advantage that imparted a change in the ratio of linear movement of the rack 150 to the lengthening of the biasing member 160.

As the first drawer slide member 14 continued to move toward an open position, the curved slot of the actuation member 90 forced the pin 146 laterally, causing the hook portion 144 on the latching member 140 to enter the notch 132' of the slide channel 132, achieving a latched or armed position, as shown in FIG. 6B. So, FIG. 6B shows the actuation member 140 in the latched or armed position as would occur once the first drawer slide member 14 has moved slightly further toward an open position of the drawer and the actuation member 140 is no longer being under the influence of the drawer closing device 110. The movement of the latching member 140 to its armed position also advances the rack 150 and its toothed elongated section 154 along the slide rail 138. In turn, the engagement of the rack 150 with the arcuate toothed section 172 of the gear 170 causes the gear 170 to pivot to a position against stop wall 135, limiting the pivotal movement of the gear 170. The ends of travel may be limited simultaneously or alternatively by the ends of travel of the rack 150 along its slide rail 138 and/or by the travel of the latching member 140 within the slide channel 132.

As with the first example device 10, in the second example device 110, the tab 176 on the gear 170 is positioned so that when the hook portion 144 on the latching member 140 reaches the notch 132' and assumes its armed position, the biasing member 160 has not passed the pivotal coupling of the gear 170 to the base 130, or the top-dead-center position, and instead is kept in tension and continues to bias the gear 170 to pivot toward the returned position associated with the closed position of the drawer.

With the further movement of the latching member 140 to its armed position, the pivotal movement of the gear 170 causes the biasing member 160 to be further stretched but at a reduced ratio relative to the linear movement of the rack 150 that is pivotally coupled to the latching member 140. The mechanical advantage provided with the disclosed arrangement permits the use of a biasing member 160 having a linear rate spring while effectively reducing the rate of increase in the applied spring force as the first drawer slide member 14 moves the latching member 140 toward the armed position. This arrangement results in the closing device 110 having sufficient biasing force to move and keep a drawer closed, while also having a lower ultimate biasing force present at the point of disengagement or reengagement of the drawer with the drawer closing device in comparison to prior art devices where the biasing force continues to increase at the same rate as a closing element moves. As a result, the user experiences a more pleasing transition between a drawer being under the influence of the closing device 110 and being free to move beyond the range of motion of the closing device 110.

As the drawer and the first slide member 14 move from an open position toward the closed position, the actuation member 90 at the proximal end 14' of the first drawer slide 14 reengages the pin 146 on the latching member 140 and forces the latching member 140 to pivot about the post 156 on the rack 150, withdrawing the hook portion 144 from the notch 132' at the end of the slide channel 132. With the hook portion 144 unlatched, the tensioned biasing member 160 causes the toothed gear 170 to pivot, in turn causing the toothed rack 150 to slide along the slide rail 138 of the base 130. The pivotal coupling of the rack 150 to the latching member 140 results in the latching member 140 and the drawer being pulled to the closed position.

Thus, as the drawer is advanced toward a closed position within the cabinet body, the proximal end 14' of the first drawer slide member 14 is moved within a selected range of motion proximate the proximal end 18' of the third drawer slide member 18, such as within the last two inches of travel of the drawer slide 12. In this example, the curvature in the slot of the actuation member 90 at the end of the first drawer slide member 14 is configured to assist in capturing and releasing the pin 146 on the latching member 140. The interaction between the curved slot of the actuation member 90 and the pin 146 controls the pivotal motion of the latching member 140 to force the hook 144 to selectively engage and disengage the notch 132' in the slide channel 132 of the base 130 for latching and unlatching of the latching member 140. It will be appreciated that the pin 146 may be constructed in other suitable forms or shapes, and that with some modification, the pin and slot coupling components may be reversed or incorporated into the drawer slide, drawer and/or cabinet in other suitable ways, or the latching and actuating members may be configured in other forms.

It will be appreciated that a drawer closing device in accordance with the present disclosure may be provided in various configurations. Any variety of suitable materials of construction, configurations, shapes and sizes for the components and methods of coupling the components may be utilized to meet the particular needs and requirements of an end user. It will be apparent to those skilled in the art that various modifications can be made in the design and construction of such a drawer closing device, whether or not a damper is employed, without departing from the scope or spirit of the present disclosure, and that the claims are not limited to the preferred embodiment illustrated.

While the present disclosure shows and demonstrates example drawer closing devices, the examples are merely illustrative and are not to be considered limiting. It will be apparent to those of ordinary skill in the art that various closing devices may be constructed to be installed in various forms of drawer slides or cabinet assemblies, without departing from the scope or spirit of the present disclosure. Thus, although example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A closing device comprising:

a base;

a latching member that is coupled to a rack that slidably engages the base;

a gear coupled to the base and engaging the rack;

a biasing member having a first end coupled to the base and a second end directly coupled to the gear; and wherein the biasing member generates a biasing force as it is lengthened thereby moving the gear and causing the rack and the latching member to slide along the base, and the rack and gear engagement provides a mechanical advantage that alters the biasing force applied to the latching member in a manner that does not correspond linearly to movement of the latching member.

2. The closing device in claim 1 wherein linear movement of the latching member relative to the base a given distance causes the second end of the biasing member to move relative to the first end of the biasing member a distance that is less than the given distance moved by the latching member.

3. The closing device in claim 1 wherein the latching member includes a hook portion and the base includes a notch portion configured to receive the hook portion.

4. The closing device in claim 1 wherein the gear includes an arcuate toothed section and the rack includes an elongated toothed section that engages the gear.

5. The closing device in claim 1 wherein the gear is sector-shaped.

6. The closing device in claim 1 wherein the gear is pivotally coupled to the base.

7. The closing device in claim 6 wherein movement of the gear and the coupling of the second end of the biasing member to the gear are limited such that the biasing member is prohibited from passing the pivotal coupling of the gear to the base.

8. The closing device in claim 1 wherein the base further comprises a slide channel and the latching member is slidably engaged with the slide channel.

9. The closing device in claim 1 wherein the biasing member is in the form of a coiled spring.

10. The closing device in claim 1 further comprising a damper that dampens movement of the latching member in at least one direction.

11. The closing device in claim 10 wherein the damper has a housing coupled to the base.

12. The closing device in claim 10 wherein the damper includes a rod coupled to the rack.

13. A closing device, for use in a drawer slide having a first drawer slide member that is slidably coupled to a second drawer slide member, the closing device comprising:

a base connectable to the second drawer slide member;

a latching member slidably coupled to the base;

the latching member having an armed position and a closed position;

the latching member being coupled to a rack that is slidably engaged with the base;

a gear pivotally coupled to the base and being engaged with the rack;

a biasing member coupled to the base and directly coupled to the gear, the biasing member being adapted to urge the gear to pivot and thereby drive the latching member to a closed position.

14. The closing device in claim 13 wherein the biasing member is coupled to the base and the gear in a configuration wherein slidable movement of the latching member relative to the base a given distance results in the biasing member changing in length a distance that is not equivalent to the given distance moved by the latching member.

15. The closing device in claim 13 wherein the gear further comprises teeth and the rack further comprises teeth that engage the teeth of the gear.

16. The closing device in claim 13 wherein the pivotal movement of the gear and the coupling of the biasing member to the gear are limited such that the biasing member exerts a biasing force on the gear that continuously biases the gear to rotate in one direction.

17. The closing device in claim 13 wherein the pivotal movement of the gear and the coupling of the biasing member to the gear are limited such that the biasing member is prohibited from passing the pivotal coupling of the gear to the base.

18. The closing device in claim 13 further comprising a damper that is coupled to and dampens movement of the latching member in at least one direction.

19. The closing device in claim 18 wherein the damper further comprises a housing coupled to the base and a rod coupled to the rack.

20. The closing device in claim 13 wherein the latching member is configured to be releasably engaged by the first drawer slide member,

21. A drawer closing device comprising:

a base having a slide channel;

a latching member slidably engaged within the slide channel;

the latching member being connected to a rack that is slidably engaged with the base;

a gear pivotally connected to the base and having toothed engagement with the rack;

a biasing member being directly connected to and disposed between the base and the gear, the biasing member configured to pivot the gear thereby causing the rack to slide along the slide channel;

wherein movement of the latching member within the slide channel a given distance causes movement of the biasing member that is a distance less than the given distance moved by the latching member.

22. The drawer closing device in claim 21 wherein the latching member includes a hook portion and the slide channel includes a notch portion configured to receive the hook portion.

23. The drawer closing device in claim 21 wherein the gear is sector-shaped.

24. The drawer closing device in claim 21 wherein the pivotal movement of the gear and the connection of the biasing member to the gear are limited such that the biasing member is prohibited from passing the pivotal connection of the gear to the base.

25. A drawer closing device comprising:

a base having a slide channel with a notch portion at a distal end;

a latching member having a central body slidably engaged with the slide channel and having a hook portion engagable with the notch portion;

the latching member being connected to a rack having an elongated toothed section, with the rack being slidably engaged with the base;

a gear having an arcuate toothed section engaged with the elongated toothed section of the rack and being pivotally connected to the base;

a biasing member being connected at a first end to the base and at a second end to the gear;

wherein when the latching member is moved within the slide channel a given distance, the second end of the biasing member is moved relative to the first end of the biasing member a distance that is a portion of the given distance moved by the latching member within the slide channel.

26. The drawer closing device in claim 25 further comprising a damper that dampens movement of the latching member in at least one direction.

27. The drawer closing device in claim 26 wherein the damper has a housing connected to the base.

28. The drawer closing device in claim 27 wherein the damper includes a rod connected to the rack.

29. The drawer closing device in claim 25 further comprising a pin on the latching member configured to engage a slot on a drawer slide member to move the latching member within a preselected range of movement.

* * * * *